US005155495A

United States Patent [19]

Hately et al.

[11] Patent Number: 5,155,495

[45] Date of Patent: Oct. 13, 1992

[54] RADIO ANTENNAS

[76] Inventors: Maurice C. Hately, 1 Kenfield Place, Aberdeen AB1 7UW, Great Britain; Fathi M. Kabbary, 2 Okasha Street Flat 15, Dokki, Cairo, Egypt

[21] Appl. No.: 543,768

[22] PCT Filed: Jan. 27, 1989

[86] PCT No.: PCT/GB89/00080

§ 371 Date: Jul. 18, 1990

§ 102(e) Date: Jul. 18, 1990

[87] PCT Pub. No.: WO89/07348

PCT Pub. Date: Aug. 10, 1989

[30] Foreign Application Priority Data

Feb. 2, 1988 [GB] United Kingdom ..... 8802204

[51] Int. Cl.[5] ..... H01Q 21/00

[52] U.S. Cl. ..... 343/725; 343/726; 343/727; 343/728

[58] Field of Search ..... 343/725, 726, 727, 728, 343/729, 741, 866, 825

[56] References Cited

U.S. PATENT DOCUMENTS 3,521,284 7/1970 Shelton, Jr. ..... 343/727
4,809,009 2/1989 Grimes et al. ..... 343/726

FOREIGN PATENT DOCUMENTS 453660 12/1948 Canada ..... 343/726
492418 4/1953 Canada ..... 343/726

*Primary Examiner*—Michael C. Wimer
*Assistant Examiner*—Hoanganh Le
*Attorney, Agent, or Firm*—Lowe, Price, LeBlanc & Becker

[57] ABSTRACT

An antenna for a wide bandwidth electromagnetic field polarized in a predetermined direction at right angles to the field propagation direction includes plural metal elements that are not resonant in the bandwidth. The metal elements are excited to transduce an electric field in the polarization direction over the bandwidth range. The plural elements have an extent in the polarization direction no greater than an order of magnitude of the shortest wave length in the bandwidth. A structure between the element, which may be either a coil or parallel electrodes which derive a displacement current, transduces a magnetic field having lines of flux at right angles to the polarization and propagation directions. The electric and magnetic fields are excited by power from the same source with phases so that in an interaction region of the field between a pair of the metal elements there is E×H synchronism and a radiation Poynting vector having rotational E and H fields to transduce the electromagnetic field.

36 Claims, 8 Drawing Sheets

RADIO ANTENNAS

FIELD OF THE INVENTION

This invention relates to antennas for the transmission and reception of radio waves for telecommunications, broadcasting sound and television, radar, satellite communications and the like.

Known antennas usually have a single feeder connected to either a single conductor element of approximately half a wavelength, or to a single driven element within a group of parasitic elements as in the Yagi-Uda array. By means of added reactive components such as inductors, end capacitors, resonant traps and such, antennas have been constructed with somewhat smaller dimensions than the basic half wavelength element. Loop antennas are also known and are useful in direction finding. However most antennas of reduced dimensions have disappointing transmission efficiency due to the necessarily increased circulation currents which cause large conductor losses and or magnetic core losses.

BACKGROUND ART

The Poynting Theorem states that for any superimposed electric and magnetic fields there must be energy flowing in the medium and thus the phenomenon of radio wave propagation has been explained in the presently accepted theory as the radiation of electromagnetic energy in the form of an electric field E and a magnetic field H in a cross-product Poynting vector $E \times H = S$ watts per meter squared. The perpendicular geometric relationship and the time synchronism implied by the above formula must be produced by any antenna which is to radiate efficiently. Presently known antennas are probably achieving the requirements in an uncontrolled or accidental manner.

Due to extended physical dimensions and high location above the ground, it is probable that there is fortuitously provided in the large volume of space a means of setting the necessary perpendicularity and simultaneity as well as a degree of rotationality for the fields, although the absence of these conjectures from the present texts ought not to be used to condemn the validity of the concept. From the large surrounding and lightly stressed volume the comparatively weak Poynting vector progresses outwards to infinity.

THE INVENTION

In accordance with one aspect of the invention a radio antenna in which electromagnetic waves are radiated from a small volume comprises two first and second separate element systems respectively excited for producing high frequency electric and magnetic fields. Separate feeder means drives each of the element systems. Each of the element systems is positioned in adjacent interactive relationship to cross stress a common interaction zone of both fields to create a source from which electromagnetic waves radiate. The element system in which the electric field is originated establishes a radio frequency potential difference across an interaction zone between two conducting surfaces. The element system for establishing the magnetic field includes two other conducting surfaces for establishing an intense radio frequency displacement current. A radio frequency potential difference of the same frequency is applied between two of the conducting surfaces for establishing an intense circulating magnetic field to cross the interaction zone.

In a preferred embodiment a phasing unit splits an output of a radio transmitter into two parts having separate delay arrangements to produce synchronized electric and magnetic fields at the interaction zone. The phasing unit preferably includes fixed and variable phase delay circuits and at least one tapped transformer and a switch for adjusting each part of the output of the radio transmitter. The phasing unit also preferably has a wideband constant phase different circuit for low power operation for driving either of the separate units. Two separate power amplifiers develop sufficient power to provide separate feeds to the two separate element systems of the antenna so that within the interaction zone radio wave power is synthesized.

In another embodiment a single feeder is connected to one element system and a second feeder drives the other element system with a phase and magnitude to synthesize a radio frequency wave at a predetermined frequency band.

In another embodiment, the two separate element systems are constructed as half structures with a conducting surface of sufficient area that the other half structure is defined by a virtual image thereof.

In accordance with a further aspect of the invention, an antenna comprises a first set of at least two spaced elements defining surface lying an end to end relationship with each other. Radio frequency power is fed to the set of elements for producing an E-field between the set of elements. A second set of at least two spaced elements defines surfaces in face to face parallel planes. Radio frequency power produces a displacement current between the second set of spaced elements establishes an H field around the second set. The first and second spaced elements and means for feeding the radio frequency power are arranged so there is interactive coupling between the E and H fields to produce a propagating electromagnetic radio wave.

In accordance with one embodiment the surfaces of the second set of elements are positioned between the surfaces of said first set of elements and perpendicular thereto. In one arrangement, the first set of elements comprises parallel circular plates. In another arrangement the first set of elements comprises plates and the second set of elements comprises parallel plates.

In one embodiment one of the fields is produced by a feed including a coaxial feeder cable coupled through a transformer including a ferrite toroidal core. The first and second sets of elements are preferably secured and spaced by electrically insulating support members. A ground-plane structure may be provided wherein one of each of the spaced set of elements is constituted by a virtual image of the other element on the other side of a ground plane element electrically bisecting the antenna.

In accordance with a further aspect of the invention, an antenna for wide bandwidth electromagnetic field polarized in a predetermined position at right angles to the field propagation direction comprises plural metal first elements that are not resonant in the bandwidth. The first elements are excited to transduce an electric field in the polarization direction over the bandwidth and have an extent in the polarization direction no greater than an order of magnitude less than the shortest wavelength in the wide bandwidth range. Means between the elements transduces a magnetic field having lines of flux between the elements at right angles to the polarization and propagation directions. The elements and means are arranged and the electric and magnetic fields are excited by power from the same source with phases so there is an interaction region of the fields between a pair of the metal elements to provide E×H synchronism and a radiation Poynting vector having rotational E and H fields to transduce the electromagnetic field. The elements include first and second metal plates having spaced planar faces substantially at right angles to the electric field. The plates are excited with voltages displaced in phase by 180° so the electric field is established between said planar faces. A coil disposed between the plates has windings positioned to excite the lines of flux. The coil is excited with current from the same source which excites the plates with a current displaced in phase by 90° relative to the voltages which excite the plates.

In one embodiment, the faces of the plates diverge from a central region where the coil is located so curved electric field lines extend between the plates.

In another embodiment, the elements include first, second, third and fourth metal plates having spaced planar faces substantially at right angles to the electric field. The first and second plates are excited with a first voltage having the same phase while the third and fourth plates are excited with a second voltage having the same phase. The first and second voltages are from the same source and displaced in phase from each other by 180°. A coil disposed between the plates has windings positioned to excite the lines of flux. The coil is excited with current from the same source which excites the plates with a current displaced in phase by 90° relative to the voltages which excite the plates. Preferably, the faces of the plates diverge from a central region where the coil is located so curved electric field lines extend between the first and third plates and between the second and fourth plates.

In a further embodiment, at least one of the metal elements has a first surface extending (a) in substantially the same direction as the electric field, (b) at substantially right angles to the magnetic lines of flux and (c) at substantially right angles to the propagation direction so the electric field is curved as it propagates from the first surface to a second surface of another of the metal elements. The elements including the first and second surfaces are excited with voltages from the same source that are displaced 180° from each other. Preferably, the another element including the second surface is configured so the first and second surfaces extend in substantially the same direction. In one embodiment the first and second surfaces are substantially planar and substantially aligned. In a second embodiment the first and second surfaces are cylindrical and have substantially the same radii and substantially common axes. The another second element may be a planar surface extending in a plane substantially parallel to the propagation direction. In this case, the first surface is cylindrical and the first surface has an axis substantially at right angles to the plane of the second element. In the further embodiment, the magnetic field is transduced by a coil disposed between the elements and having windings positioned to excite the lines of flux. The coil is excited with current from the same source which excites the elements with a current displaced in phase by 90° relative to the voltages which excite the elements. In this arrangement the another element is configurated so the first and second surfaces extend in substantially the same direction and the first and second surfaces are preferably substantially planar and substantially aligned.

In still another embodiment the magnetic field is transduced by a capacitor having first and second substantially parallel planar electrodes extending substantially in the direction of propagation and substantially at right angles to the electric field lines. The electrodes are excited so voltages phase displaced from each other by 180° are applied to the first and second electrodes so a displacement current correlated with the magnetic field subsists. In this arrangement, preferably at least one of the metal elements has a first surface extending (a) in substantially the same direction as the electric field, (b) substantially at right angles to the magnetic lines of flux and (c) substantially at right angles to the propagation direction so the electric field is curved as it propagates from the first surface to a second surface of another of the metal elements. The elements are excited by a means including the first and second surfaces with voltages from the same source that are displaced 180° from each other. The another element is preferably configured so the first and second surfaces extend in substantially the same direction and the first and second surfaces are substantially planar and substantially aligned.

The first and second surfaces are cylindrical in still another arrangement wherein the first and second surfaces have substantially the same radii and substantially common axes. The second element may include a planar surface that extends in a plane substantially parallel to the propagation direction, in which case the second element preferably includes the second electrode. A first cable includes a first feed line extending through a central aperture of the first electrode. The first line is connected to the first element and a second line connected to the second element. A second cable including third and fourth lines is connected to terminals of a primary winding of a transformer having a secondary winding having opposite terminals respectively connected to the first electrode and the second element. The cables may be coaxial so the first and third lines are respectively center conductors of the first and second cables and the second and fourth lines are respectively shields of the first and second cables.

The invention is further described and illustrated with reference to the accompanying drawings, showing embodiment by way of examples.

DESCRIPTION OF THE PREFERRED EMBODIMENTS

Figure 1:
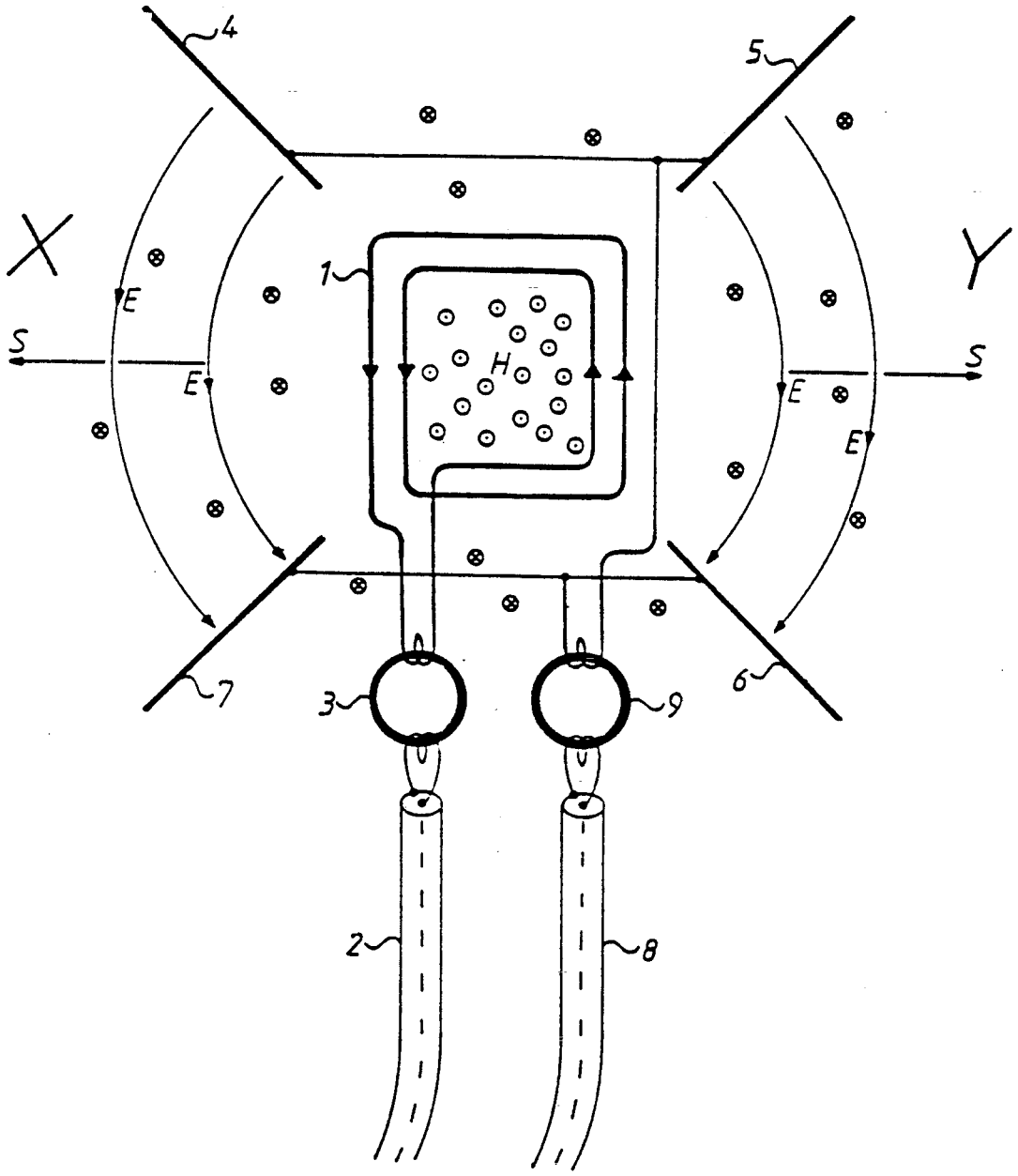
FIG. 1 is a schematic plan view of an embodiment with a horizontal coil.

FIG. 1 is a plan view of an elementary form of a twin feeder crossed field antenna according to this invention. The horizontal coil 1 is fed by feeder 2 via matching and isolating transformer 3 and carries a radio frequency current shown by arrows indicating an anticlockwise maximum in the cycle time. Thus upwardly directed in the center of the coil there is high magnetic field density H from $J+D'=\nabla XH$ which returns downwards all around the periphery of the coil. There are two pairs of conducting plates 4 and 5, 6 and 7, with planes standing vertically which are insulated from everything else but are fed with antiphase voltage of the same frequency in pairs as shown, by power in feeder 8 via matching and isolating transformer 9. At the same instant in the cycle the plate pair 4 and 5 are electrically positive relative to the plate pair 6 and 7. Thus due to the very small dimension of the whole antenna, the propagation delay across the interaction zones marked X and Y is negligible and so the correct simultaneity, orthogonality and rotationality exists and Poynting vector synthesis occurs and radio power radiates away with the velocity of light in the directions marked S.

Figure 2:
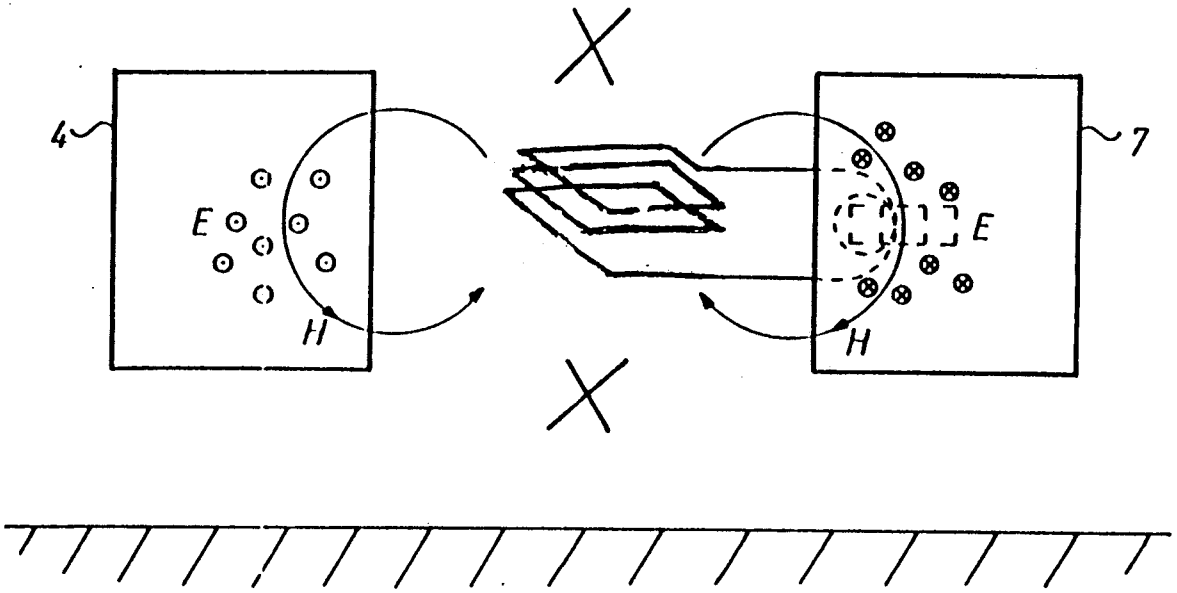
FIG. 2 is a schematic elevation view of the embodiment of FIG. 1.

FIG. 2 is a diagram of the same antenna in elevation.

Detailed consideration of the phase requirement may be deduced as follows. Sinusoidal carrier waves are being applied and electric field E is in phase with the voltage across the plate pairs. The retardation due to size is negligible as is the magnetic field retardation around the coil. Thus the field H is in synchronism with the current causing it, that is the magnetic field is in phase with the current. Current in a coil is however always lagging by about 90° relative to the voltage across the coil due to self inductance. So, in order to obtain phase synchronism of the fields interacting in the crossed field antenna, the feed voltage to the coil needs to be approximately 90° advanced on the feed voltage between the electrical plates. If both transformers have identical phase characteristics, the signal to feeder 2 must to be phase advanced by 90° compared with the voltage supplied to feeder 8. Cable lengths are only significant if different, so for a single frequency application an electrical quarter wavelength extra in feeder 8 would fulfil the phase requirement. By providing a power divider so that a single transmitter supplies approximately half the power to each of the twin feeders, the interaction zone radiates the total power in the synthesised Poynting vector An antenna for general radio communications requiring many operational frequency changes must to have a phase adjusting unit.

Figure 3:
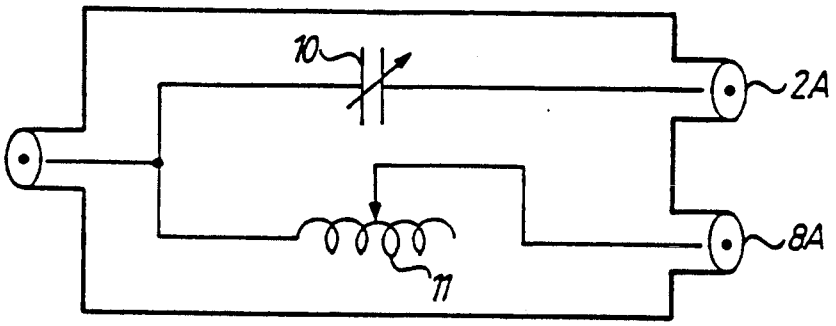
FIG. 3 is a circuit diagram for phasing unit for feeding an antenna according to the invention.

FIG. 3 is a circuit diagram of a simple phasing unit with which the said phase adjustment could be provided The transmitter power is split partly into the upper capacitive path and partly into the lower inductive path. Setting the capacitor 10 to some value will give 45° advance; setting the inductor to another value will result in a corresponding 45° delay which will ensure that after stimulating the two fields the radio wave will be correctly synthesised in the interaction zones.

Figure 4:
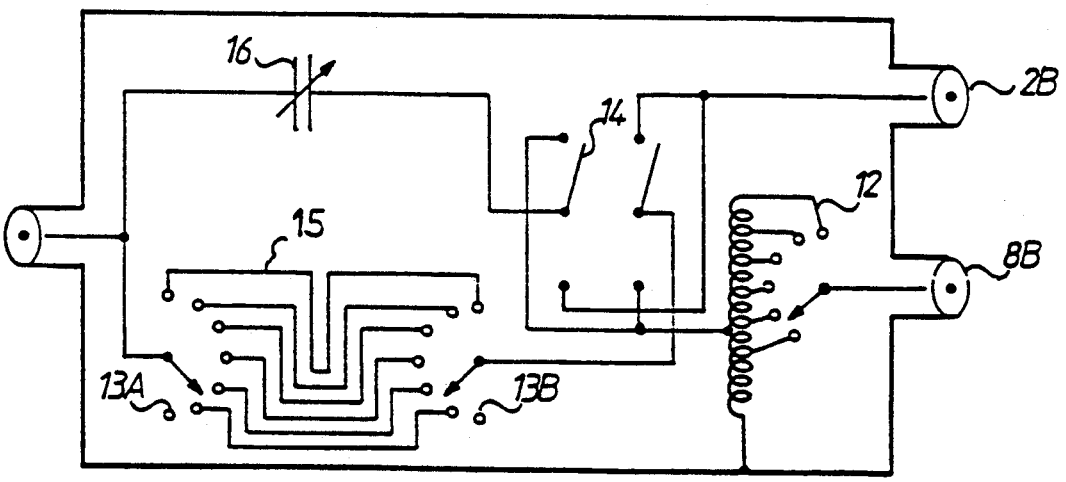
FIG. 4 is a circuit diagram of a further feeder unit.

FIG. 4 shows a more sophisticated form of phasing unit which will provide phasing for any kind of twin feeder crossed field antenna under almost any circumstances over a wide frequency range. A switched auto transformer 12 is connected to feeder output 88 and is preceded by phase adjustment arrangements switchable into either sense by switch 14, of which coarse settings are provided by the dual gang switch 13A, 13B and a selection of cable lengths 15, and a fine adjustment by the variable capacitor 16.

A more complex phase adjustment system, (not shown) would have a series of two-pole change-over switches able to connect any total combination of delay cables selected from a sequence of lengths incremented in a $\frac{1}{8}$, $\frac{1}{4}$, $\frac{1}{2}$, 1, 2, 4, 8, 16, 32 metersystem. Such a scheme would allow a user to correct the phase of the feed to a crossed field antenna such that a single device could be radiating successfully at any frequency in the whole HF spectrum.

In a further preferred arrangement the phasing unit has a wideband constant phase difference circuit for low power operation and followed, either inside the unit or outside as two separate units, by two separate power amplifiers which develop sufficient power to provide separate feeds to the two electrode systems of the antenna so that within the interaction zone sufficient radio wave power is synthesised.

Figure 5:
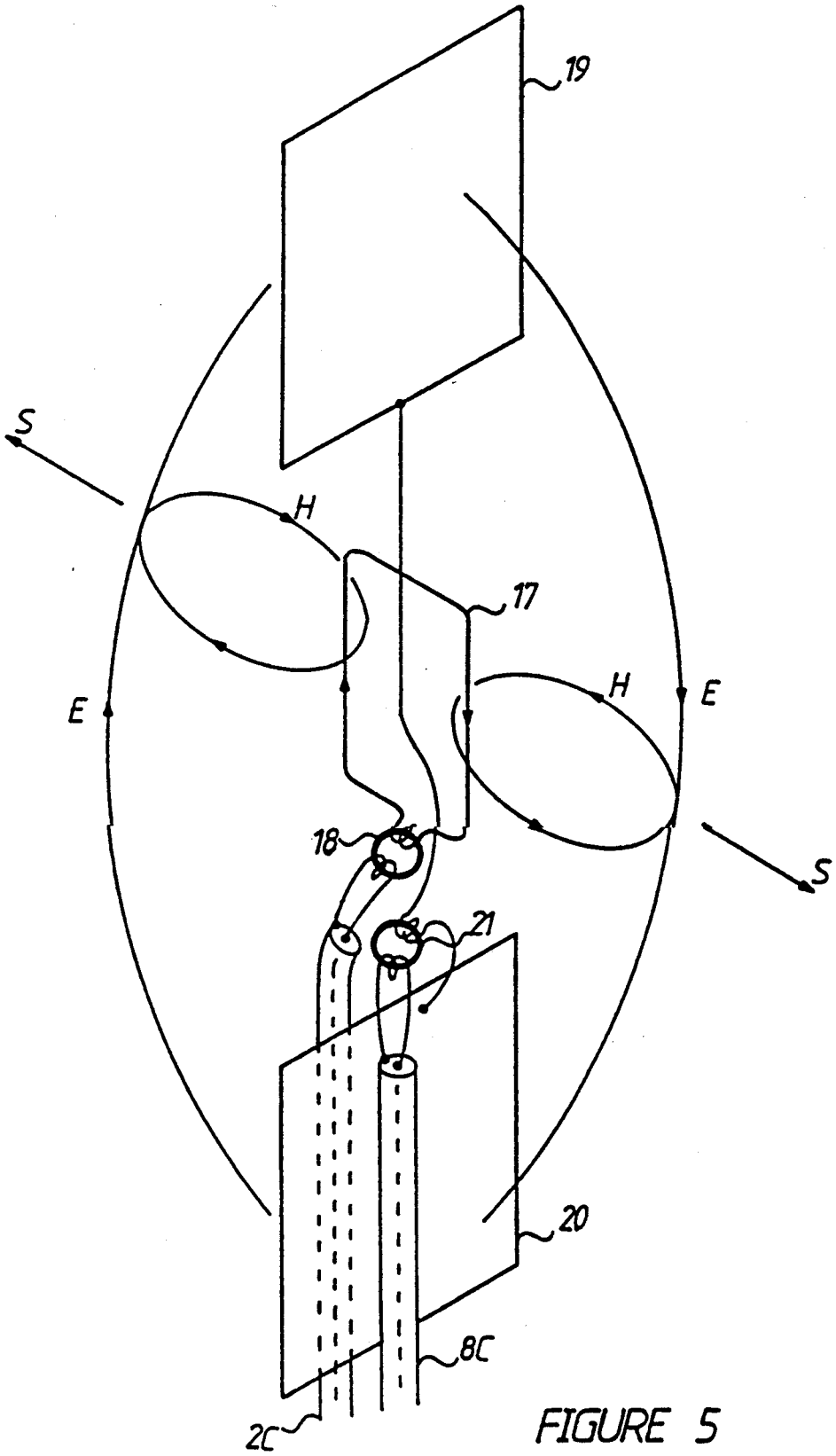
FIG. 5 is a schematic perspective view of another embodiment for radiating of vertically polarized waves.

An alternative twin feeder crossed field antenna which will radiate vertically polarized waves instead of horizontal, is shown in FIG. 5. The antenna consists of a narrow vertical coil 17 fed from cable 2C via matching transformer 18, and two conducting plates 19 and 20 fed by feeder 8C via matching and isolating transformer 21. A widespread electric field E is created in arcs from the top plate to the lower plate and produces a cross-product with the magnetic field H rotating in the directions indicated and thus synthesises intense Poynting vectors S which radiate outwards in broad azimuthal angles to space. The said antenna having several advantageous features namely a reduced number of components and also a larger interaction volume than has the first type according to FIGS. 1 and 2. The first feature reduces costs and simplifies the structure. The second advantage gives enhanced signal voltages when used in the receive mode. Furthermore, since any one of the four input terminals (two plates and two coil terminals) may be connected to earth it will be optimal to have the lower plate earthed for safety as well as providing an opportunity to bond the screens of the coaxial feeders thereto.

It is possible for transformer 21 to be dispensed with, and direct feed from the inner conductor of feeder 8C to be connected to the upper plate 19 with the screen remaining connected to plate 20.

Figure 6:
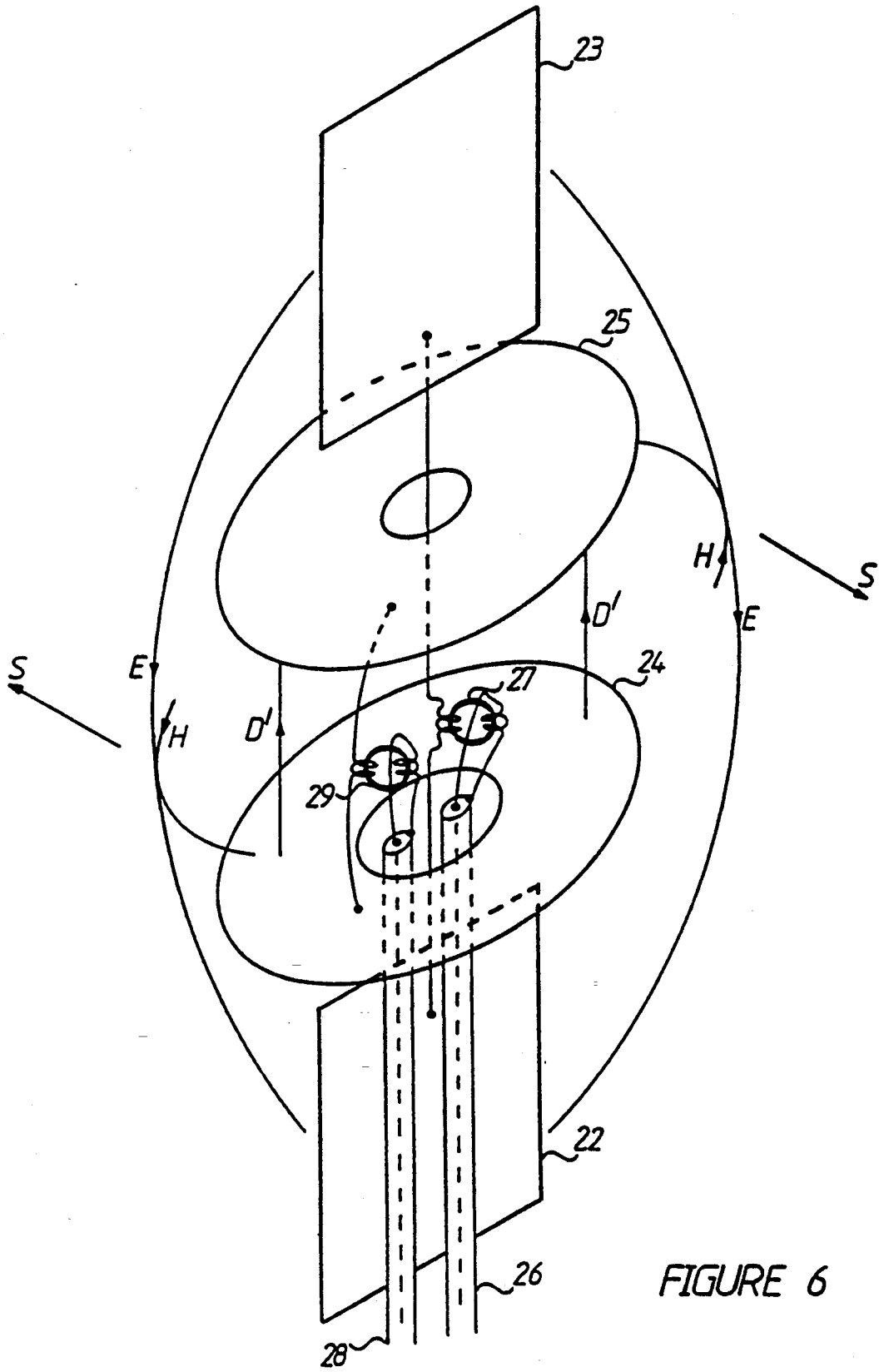
FIG. 6 is a schematic perspective view of a further embodiment using capacitive effect to produce the magnetic field.

As a further development of the twin feeder crossed field antenna types which use a coil to generate the magnetic field, a further arrangement is proposed called the Maxwell type, in which the magnetic field is produced from an electric field displacement current located within a capacitor. It is an arrangement which has many advantages theoretically and practically, and allows the construction of a truly omnidirectional vertically polarised antenna. Examination of the Maxwell law $D'=\nabla XH$ where $D'=\delta D/\delta t$ shows that a changing displacement field causes a rotational magnetic field. As the displacement current density is simply related in space (or in air) by the formula $D'=\epsilon E'$ where E is the electric field intensity and $\epsilon$ is the dielectric constant, it is easy to calculate that this will be a very useful technique for HF crossed field antennas of small size. Also it can be seen that as before, the $S=E\times H$ relationship of the Poynting vector demands geometric perpendicularity synchronism and rotational form to both fields The differentiation with respect to time within the Maxwell law again inserts a 90° phase change but in this type it is of the opposite sign. There is a 90° advance of magnetic field relative to the voltage gradient and so there must be a 90° delay in the voltage fed to the plates of the said capacitor. The Maxwell type of crossed field antenna requires two separate electric field stimulator plates; one pair as in the first type to initiate the E field, and the other pair to initiate the magnetic field by the Maxwell law The second pair are called therefore, the D plates. In total there are four phases of electric potential within the antenna structure: 0° and 180° of the E plates; 90° and 270° of the D plates FIG. 6 is a diagram of a basic form of the Maxwell type of twin feeder crossed field antenna. Two flat plates 22 and 23, standing vertically are insulated from other electrodes and ground and are fed by coaxial cable 26 via matching and isolating transformer 27, thereby producing the electric field E shown in the downwards phase. Two insulated flat elliptical plates 24 and 25, disposed horizontally are also insulated from earth and other electrodes and constitute the capacitor within which a large displacement current density D' is produced by radio frequency power arriving from feeder 28 via matching and isolating transformer 29. The rapidly changing displacement current is then the origin of the considerably curved H around the whole antenna in the direction shown. In the wide interaction zones at mid height, in front of and behind the structure, copious field crossing is present and so considerable Poynting vector power density is generated and radio waves propagate away at the velocity of light in the directions shown S. The waves are vertically polarised; the horizontal polar diagram is a figure of eight. The lower plate may be earthed and the screens of the coaxial feeders bonded to it. The transformer 27 may be dispensed with and a direct connection made between the inner of the feeder 26 and the plate 23.

Many variants of the Maxwell type are conceivable and they constitute a generic family of twin feeder crossed field antennas disclosed herein. For instance the form described in FIG. 6 could be turned through 90° and it will then generate horizontally polarised waves and have a radiation polar diagram which is a figure of eight in the horizontal plane.

Figure 7:
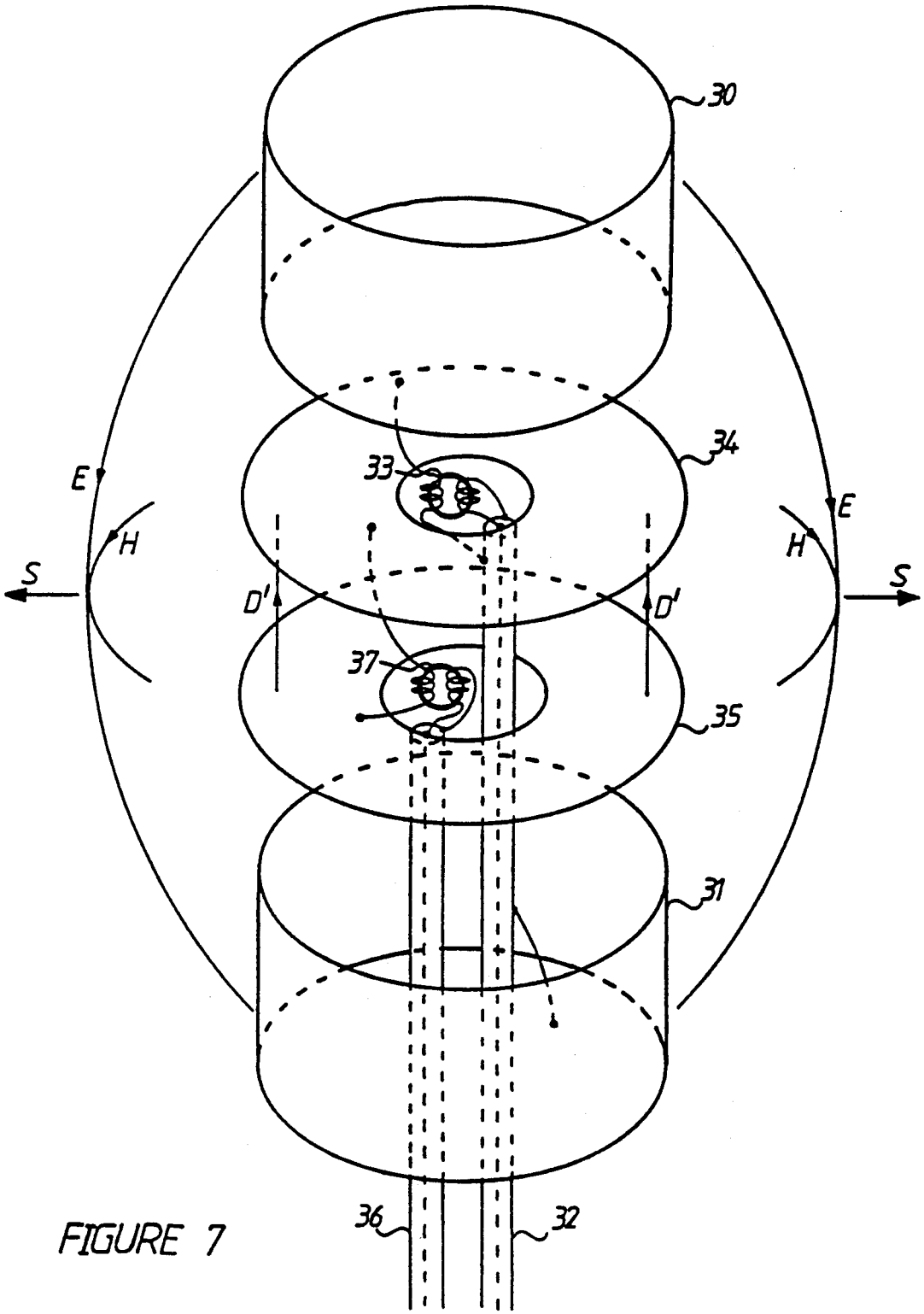
FIG. 7 is a schematic perspective view of an embodiment similar to FIG. 6 using cylindrical elements.

Two further antennas of this family will b described as they are important in having a robust structural shape as well as a vertically polarised omnidirectional radiation which is often required in broadcasting and communicating to mobiles FIG. 7 is a diagram of the cylindrical form of Maxwell type crossed field antenna. The downwards electric field E is initiated by voltage between the hollow cylindrical conducting electrodes 30 and 31 which are fed from feeder via matching transformer 33 The lower cylinder may stand safely on the ground or could be formed as a flat plate on site. The displacement current D' is stimulated upwards at the same time in the cycle by feeding the appropriate phase voltage between the two horizontal disc conductors 34 and 35 (having their central area removed for space to mount transformers, feeders etc.) using feeder 36 via matching and isolating transformer 37. Should there be a requirement to reduce weight or wind resistance, the said electrodes and conductors may be made with alternative materials such as conducting wire mesh, or a conducting surface applied to a plastics or other non-conducting structural component.

Figure 8:
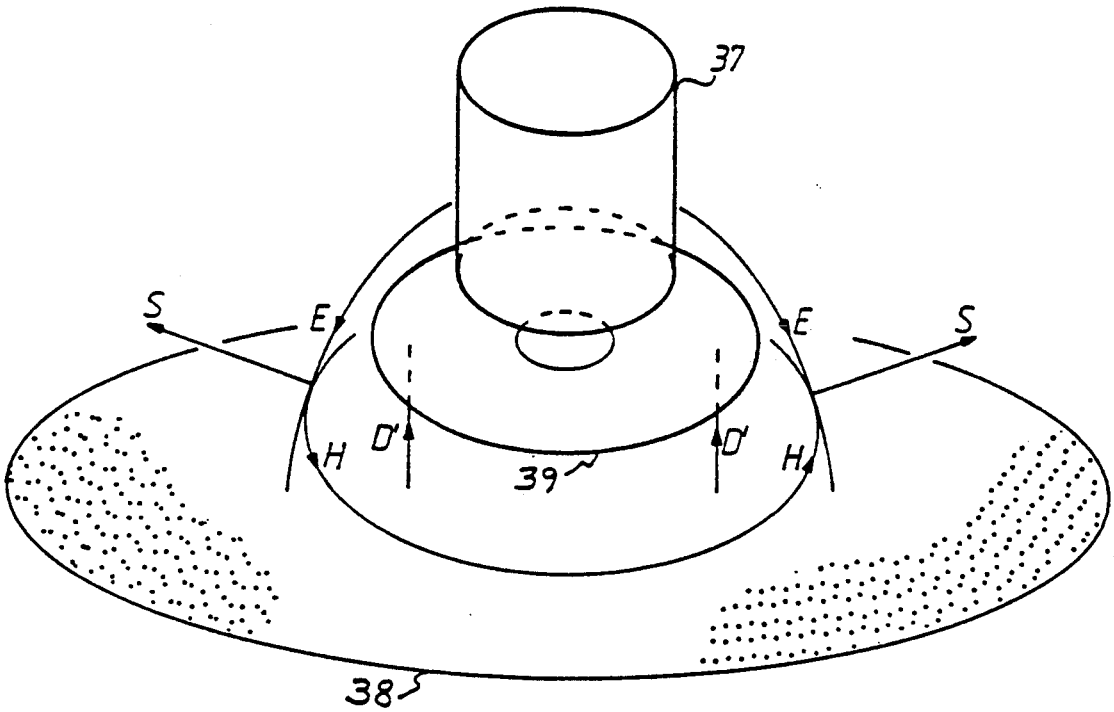
FIG. 8 is a schematic perspective view of an embodiment forming a ground plane construction.

FIG. 8 is a diagram of a ground plane (or half symmetry) form of the cylindrical twin feeder crossed field antenna of the Maxwell type. The downwards electric field E is produced by applying a voltage between the hollow conducting cylinder 37 and the large conducting earth plane 38 with the upwards displacement current D' from the said earth plane to the circular conducting plate 39 with a central missing area marked **39*a*** in order to create the required rotational magnetic field H to interact with the said E field and synthesise the Poynting vector S radiating all round to space.

In a practical construction for the frequency range 3.6 to 30 MHz, the cylinder 37 has a height of 25 cm and a diameter of 20 cm with the base spaced 10 cm from the plate 39. Plate 39 has a diameter of 40 cm and is positioned coplanar to and 5 cm distance from plane 38. The parts may be mechanically connected by insulating pillars or foamed plastics blocks.

Figure 9:
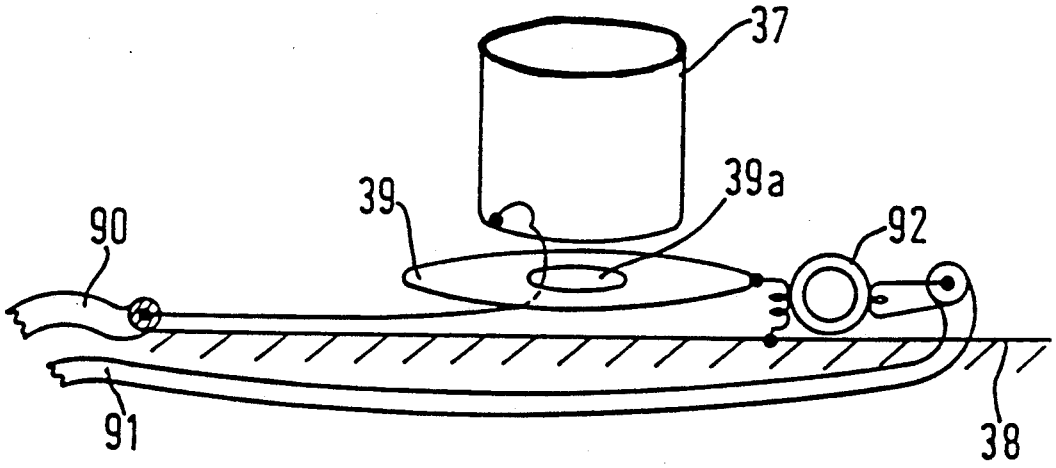
FIG. 9 is a schematic perspective view of the feed arrangement for an antenna similar to that shown in FIG. 8.

The feed arrangement is shown in FIG. 9 and this has the E-field feeder 90 connected between ground plane 38 and cylinder 37 and the H-field feeder 91 terminating in toroidal ferrite coupling transformer 92 feeding between ground plane 38 and plate 39. It is important that the outer conductor of feeder 91 is not electrically connected with any part of the structure.

For weatherproofing the structure may be encased for protection but in a preferred embodiment a louvred or apertured screen is used in conjunction with a top cover to provide air through flow.

Twin feeder crossed field antennas of the above forms or other forms may be made almost as small as desired. With correct time phasing, the power radiated from the interaction zones can be made as large as desired and is limited only by the necessary voltages at the electrodes and the ultimate possibility of corona discharge. However since the plates are large in area compared with the surface areas for wire antennas the problem is of comparative insignificance. Antennas of these types only 1/200 th of a wavelength in length (and less in diameter) have been able to radiate 400 watts on HF with no perceptible problems of electrode distress Calculations show that for the magnitudes of voltage used in wire antennas, teraWatt capabilities will be possible with crossed field antennas. There are no large circulating currents in any conductor since nothing is in resonance. It is a major advantage of the twin feeder crossed field antenna system that it is broadband, and low Q. For any given antenna radiating efficiently because it is correctly phased, the bandwidth is very broad, firstly because of the phase-sense of frequency change acting by the Maxwell Law is the same sense as change due to a wave on the delay cable, secondly because the two fields are both originated from capacitor stimulus and also change in the same phase sense, thirdly the two fields interact in such a way as to provide a lower input impedance in each capacitor and therefore self-optimise the synthesis. Thus an antenna which is say 1/400 th of a wavelength height may be expected to have a small depreciation of efficiency by a frequency change of about plus and minus 15%.

Many of the electrical properties of the system described are not critical. For instance the adjustments needed in the phasing unit to produce a low VSWR in the common feeder leading will be found in practice to be self-optimising. The magnetic field generated around the displacement current capacitor is in the direction of curvature to reduce the impedance experienced by the electric field generator since the synthesised Poynting vector takes away power from the radio wave continuously, and at no part of the cycle does the E field find its path as impedant as normal space; it is always presented to the field lines as a power sink as long as the magnetic field H is synchronous For the same reasons, the H field lines flow into a low reluctance interaction zone of a similar power sinking nature due to the cross-curved E field in phase at all times. Only in the unproductive zones around the antenna do the fields experience the normal path impedance and reluctances. The crossed field antenna system is almost an efficient "open frequency" antenna It will also receive radio signals and so may be used in two way-radio systems.

In fact the new device is such a small sized source that many techniques not before possible are now within easy achievement. When used in a reflecting or phasing arrangement, the crossed field antenna allows perceptible directivity to be attained in either transmit or receive modes even when the waves concerned are much larger than the reflector or array diameter.

The radio antenna may be used to radiate or receive electromagnetic waves when mounted within or along with other conductors, or conducting surfaces in order to reflect, direct, focus or enhance the said radiation or fed with either constant phase related power in parts, or varying phase power in parts so that a shaped radiation pattern is produced by the array and may be directed in any desired direction or directions.

The invention also relates to the use of the antenna for radio communication through a medium comprising ground, water, air or space.

We claim:

1. A radio antenna in which electromagnetic waves are radiated from a small volume comprising two separate element systems, one of said systems being excited for producing a high frequency electric field, and the other of said systems being excited for producing a high frequency magnetic field, separate feeder means driving each of said elements systems, each of said element systems being positioned in adjacent interactive relationship to cross stress a common interaction zone of both said fields to create a source from which electromagnetic waves radiate, the element system in which said electric field is originated including means for establishing a radio frequency potential difference across an interaction zone between two conducting surfaces and in which the element system for establishing the magnetic field includes two other second conducting surfaces for establishing an intense radio frequency displacement current, and means for applying a radio frequency potential difference of said same frequency between the said second surfaces for establishing an intense circulating magnetic field and causing a significant portion of the circulating magnetic field to cross said interaction zone.

2. A radio antenna according to claim 1 further including a phasing unit for splitting an output of a radio transmitter into two parts having separate delay arrangements to produce synchronized electric and magnetic fields at the interaction zone.

3. A radio antenna according to claim 2, wherein the phasing unit includes fixed and variable phase delay circuits and at least one tapped transformer and switch for adjusting each said part of the output of the said radio transmitter.

4. A radio antenna according to claim 3, wherein the phasing unit has a wideband constant phase difference circuit for low power operation and for driving two separate power amplifiers for developing power to provide separate feeds to the two separate element system of the antenna so that within the interaction zone sufficient radio wave power is synthesized.

5. A radio antenna according to claim 1 further including a single feeder connected to one element system and a second feeder for driving the other element system with a phase and magnitude to synthesize a radio frequency wave at a predetermined frequency band.

6. A radio antenna according to claim 1 wherein the two separate element systems are constructed as half structures with a conducting surface of sufficient area that the other half structure is defined by a virtual image thereof.

7. A antenna comprising a first set of at least two spaced elements defining surfaces lying in end to end relationship with each other, means for feeding radio frequency power to the set of elements for producing an E-field between the set of elements, a second set of at lest two spaced elements defining surfaces in face to face parallel planes, means for feeding radio frequency power to produce a displacement current between the second set of spaced elements for producing an H field around the second set, the first and second spaced elements and the means for feeding being arranged such that there is interactive coupling between said E-field and said H-field to produce a propagating electromagnetic radio wave.

8. An antenna according to claim 7, wherein the surfaces of said second set of elements are positioned between the surfaces of said first set of elements and perpendicular thereto.

9. An antenna according to claim 8, wherein the first set of elements comprise coaxial cylinders, the second set of elements comprising parallel circular plates.

10. An antenna according to claim 8, wherein the first set of elements comprise plates, the second set of elements comprising parallel plates.

11. An antenna according to claim 7 wherein the means for feeding radio frequency power to the elements for producing at least one of the fields comprises a coaxial feeder cable coupled through a transformer including a ferrite toroidal core.

12. An antenna according to claim 7 wherein said first and second sets of elements are secured and spaced by electrically insulating support members.

13. An antenna according to claim 7 further including a ground-plane structure wherein one of each of the spaced set of elements is constituted by a virtual image of the other said element on the other side of a ground plane element electrically bisecting the antenna.

14. An antenna for an electromagnetic field polarized in a predetermined direction at right angles to the field propagation direction, the field having a wide bandwidth range, the antenna comprising plural metal first elements that are not resonant in said bandwidth range excited to transduce an electric field in said polarization direction over said bandwidth range, said plural elements having an extent in the polarization direction no greater than an order of magnitude less than the shortest wavelength in the wide bandwidth range, means between said elements excited for transducing a magnetic field having lines of flux between said elements at right angles to the polarization and propagation directions, said elements and means being arranged and said electric and magnetic fields being excited by power from the same source with phases so that there is an interaction region of said fields between a pair of said metal elements to provide E×H synchronism and a radiation Poynting vector having rotational E and H fields to transduce said electromagnetic field, said elements including first and second metal plates having spaced planar faces substantially at right angles to the electric field, means for exciting the plates with voltages displaced in phase by 180° so the electric field is established between said planar faces, a coil disposed between said plates and having windings positioned to excite said lines of flux, and means for exciting said coil with current from the same source which excites the plates with a current displaced in phase by 90° relative to the voltages which excite the plates.

15. The antenna of claim 14 wherein the faces of the plates diverge from a central region where the coil is located so that curved electric field lines extend between the plates.

16. The antenna of claim 14 wherein said elements include first, second, third and fourth metal plates having spaced planar faces substantially at right angles to the electric field, means for exciting the first and second plates with a first voltage having the same phase and for exciting the third and fourth plates with a second voltage having the same phase, the first and second voltages being from the same source and displaced in phase from each other by 180°, a coil disposed between said plates and having windings positioned to excite said lines of flux, and means for exciting said coil with current from the same source which excites the plates with a current from the same source which excites the plates with a current displaced in phase by 90° relative to the voltages which excite the plates.

17. The antenna of claim 16 wherein the faces of the plates diverge from a central region where the coil is located so that curved electric lines extend between the first and third plates and between the second and fourth plates.

18. The antenna of claim 14 wherein at least one of the metal elements has a first surface extending (a) in substantially the same direction as the electric field, (b) at substantially right angles to the magnetic lines of flux and (c) at substantially right angles to the propagation direction so that the electric field is curved as it propagates from said first surface to a second surface of another of the metal elements, and means for exciting the elements including said first and second surfaces with voltages from the same source that are displaced 180° from each other.

19. The antenna of claim 18 wherein said another element including the second surface is configured to that the first and second surfaces extend in substantially the same direction.

20. The antenna of claim 19 wherein the first and second surfaces are substantially planar and substantially aligned.

21. The antenna of claim 19 wherein the first and second surfaces are cylindrical, the cylindrical surfaces having substantially the same radii and substantially common axes.

22. The antenna of claim 18 wherein said another element has a planar surface that extends in a plane substantially parallel to the propagation direction.

23. The antenna of claim 22 wherein the first surface is cylindrical, the first surface having an axis substantially at right angles to the plane of the second element.

24. The antenna of claim 18 wherein the means to transduce the magnetic field includes a coil disposed between said elements and having windings positioned to excite said lines of flux, and means for exciting said coil with current from the same source which excites the elements with a current displaced in phase by 90° relative to the voltages which excite the elements.

25. The antenna of claim 24 wherein said another element is configured so that the first and second surfaces extend in substantially the same direction.

26. The antenna of claim 25 wherein the first and second surfaces are substantially planar and substantially aligned.

27. The antenna of claim 14 wherein the means to transducer the magnetic field comprises a capacitor having first and second substantially parallel planar electrodes extending substantially in the direction of propagation and substantially at right angles to the electric field lines, and means for exciting the electrodes so that voltages phase displaced from each other by 180° are applied to the first and second electrodes so that a displacement current correlated with the magnetic field subsists between the electrodes.

28. The antenna of claim 27 wherein at least one of the metal elements has a first surface extending (a) in substantially the same direction as the electric field, (b) substantially at right angles to the magnetic lines of flux and (c) substantially at right angles to the propagation direction so that the electric field is curved as it propagates from said first surface to a second surface of another of the metal elements, and means for exciting the elements including said first and second surfaces with voltages from the same source that are displaced 180° from each other.

29. The antenna of claim 28 wherein said another element in configured so that the first and second surfaces extend in substantially the same direction.

30. The antenna of claim 29 wherein the first and second surfaces are substantially planar and substantially aligned.

31. The antenna of claim 28 wherein the first and second surfaces are cylindrical, the first and second surfaces having substantially the same radii and substantially common axes.

32. The antenna of claim 28 wherein the second element has a planar surface that extends in a plane substantially parallel to the propagation direction.

33. The antenna of claim 32 wherein the second element includes the second electrode.

34. The antenna of claim 33 wherein the first electrode includes a central aperture, a first cable including a first feed line extending through the aperture and connected to said first element and a second line connected to said second element, a second cable including third and fourth lines connected to terminals of a primary winding having opposite terminals respectively connected to the first electrode and the second element.

35. The antenna of claim 34 wherein said cables are coaxial, the first and third lines being center conductors of the first and second cables, respectively, the second and fourth lines being shields of the first and second cables, respectively.

36. The antenna of claim 33 wherein the first surface is cylindrical, the cylindrical surface having an axis at right angles to the plane of the second element.

* * * * *